United States Patent [19]

Deutsch

[11] 4,379,420

[45] Apr. 12, 1983

[54] ADAPTIVE STRUM KEYING FOR A KEYBOARD ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 313,026

[22] Filed: Oct. 19, 1981

[51] Int. Cl.[3] ..... G10H 1/38; G10H 1/40; G10H 7/00

[52] U.S. Cl. ..... 84/1.03; 84/DIG. 12; 84/DIG. 22

[58] Field of Search ..... 84/1.01, 1.03, 1.13, 84/1.26, DIG. 12, DIG. 22

[56] References Cited

U.S. PATENT DOCUMENTS

| | | | |
|---|---|---|---|
| 3,967,520 | 7/1976 | Drydyk | 84/1.01 |
| 4,022,098 | 5/1977 | Deutsch et al. | 84/1.03 |
| 4,079,650 | 3/1978 | Deutsch et al. | 84/1.26 |
| 4,186,636 | 2/1980 | Roberts | 84/1.01 |
| 4,282,786 | 8/1981 | Deutsch et al. | 84/1.01 |
| 4,295,402 | 10/1981 | Deutsch et al. | 84/1.03 |
| 4,315,451 | 2/1982 | Uchiyama et al. | 84/1.03 |
| 4,327,622 | 5/1982 | Aoki | 84/1.03 |
| 4,332,183 | 6/1982 | Deutsch | 84/1.26 |

*Primary Examiner*—Stanley J. Witkowski
*Attorney, Agent, or Firm*—Ralph Deutsch

[57] ABSTRACT

A keyboard operated electronic musical instrument is disclosed for imitating the strummed and solo modes of playing plucked fretted musical instruments. The actuated keys do not directly control the set of tone generators, but are used to automatically select one of a library of chord types which is closest to the actuated keys. A root note is chosen for each selected chord type. The selected chord type is transposed to an open chord spanning the several octaves associated with a guitar-type instrument. The selected tone generators assigned to the transposed open chord are strum keyed in sequence at a rate adaptive to the speed in which successive chords are entered on the keyboard. Provision is made for up-down strumming and to automatically enter a solo tone mode when a sequence of single notes are entered on the keyboard.

15 Claims, 10 Drawing Figures

NOTE DETECT AND ASSIGNOR
HALT INC
164-162
RESET
STATE Q FLIP-FLOP
DIVISION COUNTER
EDGE DETECT
S F/F R
Q
KEY NUMBER REGISTER
KEYSWITCH COUNTER
COMPARATOR
COMPARATOR
SOLO DETECT
CHORD DETECT
REPEAT
SOLO
REPEAT STRUM CONTROL
2
259
263
242
243
15
16
23
24
17
21
22
18
19
20
285
268
287
199
4
191

ADAPTIVE STRUM KEYING FOR A KEYBOARD ELECTRONIC MUSICAL INSTRUMENT

BACKGROUND OF THE INVENTION

1. Field of the Invention

This invention relates to electronic tone synthesis and in particular is concerned with a means for imitating a guitar-like instrument on a keyboard musical instrument.

2. Description of the Prior Art

Contemporary keyboard electronic musical instruments are capable of producing a fair imitation of the sounds produced by plucked stringed instruments. Such plucked instruments include the guitar, mandolin, banjo, ukelele as well as the classic harpischord. A problem that exists is not primarily of imitating the sounds produced by plucked stringed musical instruments, but rather the problem is that encountered in attempting to play a keyboard instrument in a fashion that is imitative of the sounds produced by strumming a fretted stringed musical instrument such as a guitar. The term "guitar" is used in a generic sense to denote a class of stringed musical instruments having a multiplicity of strings that are plucked or strummed in a sequential order.

A musician performing on a guitar divides the required dexteral skill between two hands. One hand is used to select a chord by pressing a subset of the strings against prepositioned frets. The other hand is occupied with plucking or strumming the strings.

The playing situation is generally quite different and more difficult on an electronic keyboard instrument if one attempts to imitate a guitar. The musician is forced to input all the note and keying data with a single hand. The second hand and feet are presumed to be occupied as they are usually dedicated to providing the accompaniment to the solo lines which imitate the guitar sounds. Since a guitar, for example, has six strings the musician is faced with a compatability problem of six strings versus five fingers on one hand. A further problem arises because two of the strings on a guitar are bass strings. The six open strings of a guitar are tuned to $E_2$, $A_2$, $D_3$, $G_3$, $B_3$ and $E_4$. This two octave range of notes cannot be played on a standard piano-type keyboard with a single hand.

Aside from the preceding problems of keying the notes on a keyboard to imitate a guitar, there is an additional problem of properly keying the sounds. Stringed instruments of the guitar generic type can be played in a wide variety of different modes. Two principal playing modes predominate most performances. The first is the solo mode in which only a single string is plucked at a time to sound a melodic line. The solo mode is readily imitatable with a keyboard electronic musical instrument. The second playing mode is called the strum mode in which the strings are plucked in a sequence. The strum mode is difficult to imitate on a keyboard instrument because considerable dextral skill is required to sequence through six widely separated notes of a chord in a time sequence which is imitative of a guitar strum. Further complications arise because the guitar strum time is not constant but varies in such a manner that it introduces an emotional expression into the musical performance.

A mechanical-type problem is translated to a musical choice limitation when one closely examines the implementation of a keyboard musical instrument which realistically imitates a guitar. The only restriction on the input chord data entered by a keyboard is the simple ability to span and actuate a set of keyboard switches. Certain well-known limitations can occur between the raised black keys and the white keys. The guitar player is saddled with a different set of mechanical limitations in the placement of a set of fingers on the strings. These limitations are a product of the spacing of the strings, the spacing of the frets, and the prescribed open tuning of the strings. Not all chord combinations and their inversions which are possible to key on a keyboard instrument are equally possible to finger on a guitar.

In U.S. Pat. No. 3,967,520 there is described a system for imitating a guitar using a keyboard electronic musical instrument. A preferential keying matrix is employed to restructure a one hand chord into open harmony chords spanning a two octave range while maintaining each of the input notes of the chord. The disclosed system is intended to operate primarily as the accompaniment section for a keyboard instrument by being incorporated into the lower keyboard of an organ.

SUMMARY OF THE INVENTION

In a keyboard musical instrument containing a number of tone generators, a note detector is employed to determine the switch states of the keyswitches comprising the instrument's keyboard. The keyswitches are connected in parallel octaves so that any convenient octave span can be used to key input note data. A chord detect subsystem is used to fine a true musical chord that is closest to the keyed note data so that possible accidental musical dissonances are eliminated. Using the closest chord data and its associated root note, a set of chord data is generated by a transposition means which corresponds to the associated open type chord which would normally be played on a guitar. A strum generator is employed which automatically and adaptively strums at different preselected speeds according to the rate at which chord data is inserted by actuating keyboard switches. The strum is obtained by automatically keying the ADSR envelope generators associated with each of the tone generators. A provision for a single note solo sound is automatically actuated when a sequence of single keyswitches are actuated.

An object of the present invention is to imitate strummed guitar chords in response to a keyboard set of note data.

Another object of the present invention is to change the strum timing adaptively to the manner in which chord data is entered by means of an array of keyboard switches.

A further object of the present invention is to correct possible errors in the keyboard chord data and to generate open-type chords which correspond to the chords played on a guitar.

BRIEF DESCRIPTION OF THE DRAWINGS

The detailed description of the invention is made with reference to the accompanying drawings wherein like numbers designate like components in the figures.

DETAILED DESCRIPTION OF THE INVENTION

The present invention is directed to a novel and improved method of imitating a strummed guitar by means of a keyboard electronic musical instrument.

Figure 1:
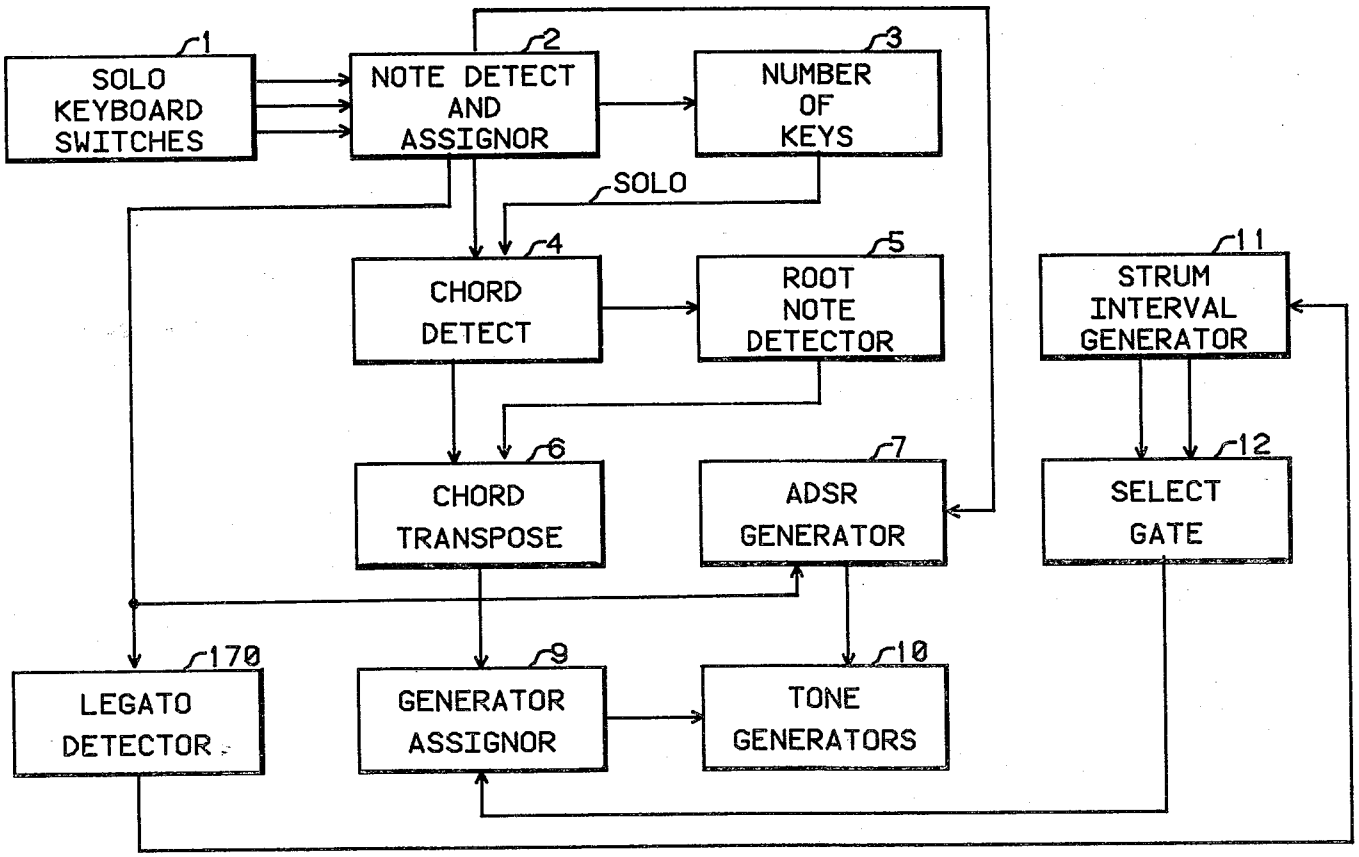
FIG. 1 is a schematic diagram of an embodiment of the present invention.

FIG. 1 shows an embodiment of the present invention. The solo keyboard switches 1 contains the usual conventional array of keyswitches used to control the tone generators in a keyboard electronic musical instrument. Each keyboard switch on the solor keyboard has two sets of independent contacts. The first set is used to control the tone synthesizers in the usual manner. The second set are called the strum switches. The instrument's second set of keyboard switches are connected in an arrangement called "parallel octaves." In a parallel octave arrangement all the notes in the scale are connected to all the same octavely related notes. Thus the $C_2$, $C_3$, $C_4$, $C_5$, $C_6$ and $C_7$ keyswitch status data signals are summed so that the corresponding keyboard switches are acting in parallel. A similar connection arrangement is used for all the other notes in the musical octave. In this fashion, input chord information can be generated by actuating a set of keyboard switches anywhere on the keyboard. The particular octave in which the keyswitches are actuated has no effect on the resultant input keyswitch status information data.

The note detect and assignor 2 is used to detect the actuations, or state changes, of the individual keyswitches contained in the solo keyboard switches 1. A suitable implementation for the note detect and assignor 2 is described in U.S. Pat. No. 4,022,098 entitled "Keyboard Switch Detect And Assignor." This patent is hereby incorporated by reference.

Figure 2:
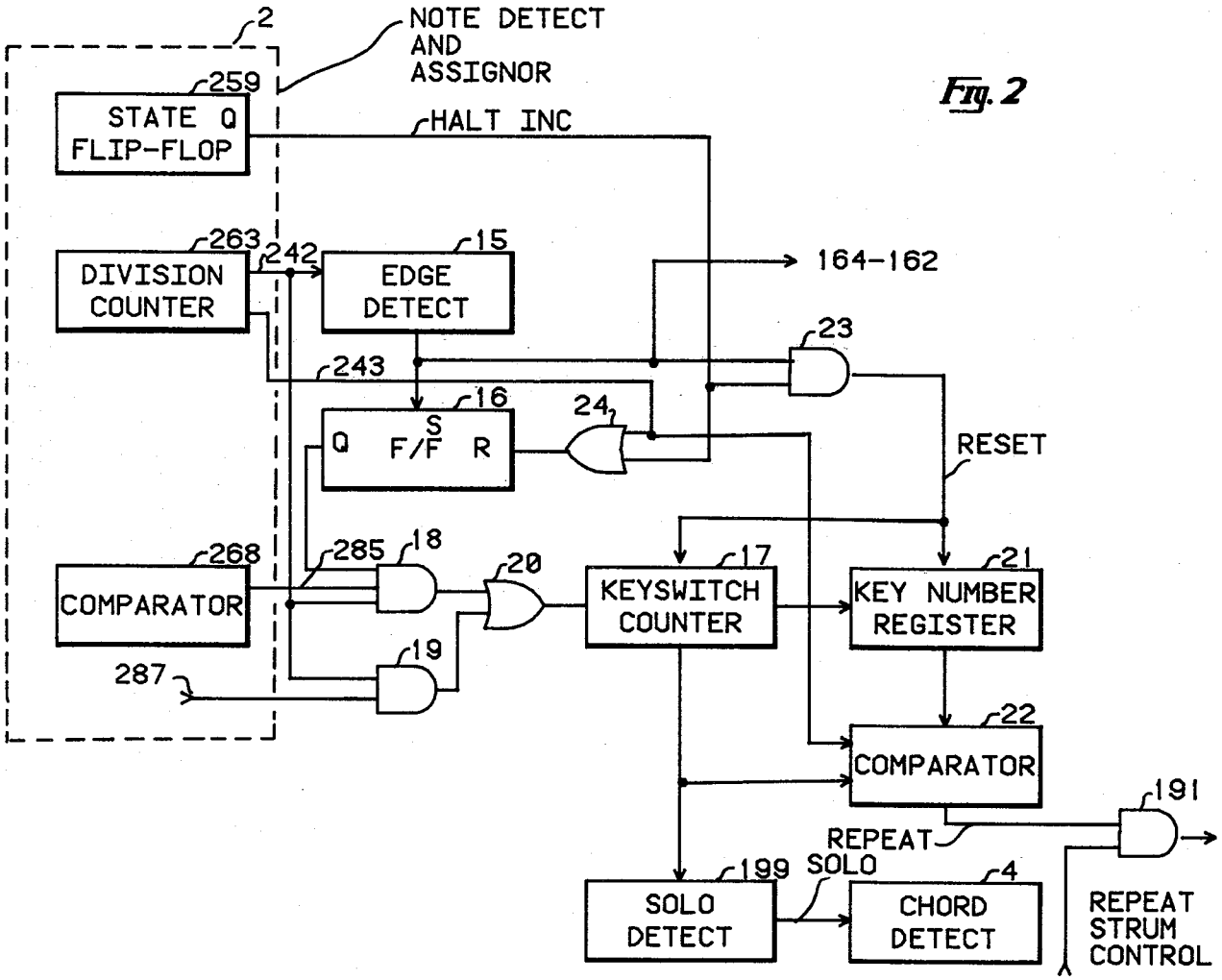
FIG. 2 is a schematic diagram of the number of keys 3 of FIG. 1.

The logic block labeled number of keys 3 is a counter means which counts the total number of actuated keyboard keyswitch states (closed switch condition) that are encountered during each complete detection scan of the array of keyboard switches. The keyboard switches are sacanned sequentially to detect changes in the keyswitch states. If only one keyswitch is in the actuated state, a SOLO signal is generated. In response to a "1" logic state for the SOLO signal, the chord detect function, implemented in the chord detect 4, selects a solo chord default option. The net result of the "1" state for the SOLO signal is that only the single actuated keyswitch data is transmitted to the tone generators 10 via the generator assignor 9. In this fashion, in a manner to be described, a single actuated keyboard switch will cause only a single tone to be generated so that single line musical passages can be played without any strumming action or without any addition of a set of notes to form a multinote chord. The detailed logic for the number of keys 3 is shown in FIG. 2 and is described below.

If more than a single keyboard switch has been detected to be in an actuated state during a complete scan of the keyboard switches, the SOLO signal will have a binary logic state of "0". In response to a "0" state for the SOLO signal, chord detect 4 will select a musical chord type from a preselected library of musical chord types which in a prescribed sense is "closest" to the set of notes corresponding to the actuated keyswitches. The logic comprising the chord detect 4 is essentially the same as that described in U.S. Pat. No. 4,282,786 entitled "Automatic Chord Type And Root Note Detector." This patent is hereby incorporated by reference.

In a manner to be described, the system disclosed in 4,282,786 is modified to prevent a major triad from being assigned as the select chord if only a single keyswitch is actuated.

The preselected library of chord types stored in the chord detect 4 is chosen to correspond to the chord types most commonly used by guitar players. The term "guitar" is used here in a generic sense to denote plucked stringed instruments including the guitar, banjo, mandolin, and ukelele. As described in U.S. Pat. No. 4,282,786 the term "closest" in the selection of a chord type is an implementation of a detection criterion which uses a least mean-square signal error between a set of matched filters and the note data set generated by a combination of actuated keyswitches.

The root note detector 5 determines a chord root note corresponding to the chord type selected from the given library of chord types by the chord detect 4.

The chord transpose 6 receives the chord type data selected by the chord detect 4 and, in response to the detected root note furnished by the root note detector 5, the chord type data is translated to note data which is used by the generator assignor 9 to assign a subset of the tone generators 10.

The legato detector 170 is used to select which of two available strum timing functions is used to operate the generator assignor 9. The ADSR generator 7 generates the envelope modulation functions that are furnished to the subset of tone generators assigned from the tone generators 10.

FIG. 2 illustrates the detailed logic of the system logic block labeled number of keys 3 in FIG. 1. In FIG. 2 all the labels in the "200" number series correspond to 200 plus the numbered labels used in FIG. 2 of the referenced U.S. Pat. No. 4,022,098. As described in the referenced patent, line 242 will have the binary logic state "1" when the upper keyboard switches are scanned to determine the curved keyboard switch states. Line 242 is used to transmit a division keyboard signal. In response to a "1" signal on line 242, edge detect 15 generates a leading edge signal. This leading edge signal is used to set the flip-flop 16 and to reset the keyswitch counter 17 to its minimum, or initial count state.

As described in U.S. Pat. No. 4,022,098 the state flip-flop 259 will be set when the keyboard scan detects a keyboard switch whose state (open or closed switch) has changed from the state it had on the previous keyboard scan. Therefore the flip-flop 16 will be reset if any keyboard switch has changed its state from that of a previous scan or if a keyboard scan has been finished and the scan is not directed to the second keyboard. A binary logic state signal "1" will appear on line 243 to the OR-gate 24 when the system is scanning the keyswitches associated with the second keyboard. Line 243 is used to transmit a division signal for the second keyboard.

When flip-flop 16 is set and the first keyboard is scanned, all the binary state signals on line 285 are transferred via AND-gate 18 and OR-gate 20 to increment the count state of the keyswitch counter 17. A "1" signal on line 285 is generated when it is found that a keyswitch which was closed in a previous keyboard scan is also closed on the present keyboard scan. A "1" signal is generated on line 287 if a closed keyswitch occurs on the present scan and was open during the previous scan. At the end of a keyboard scan, or if a HALT INC signal is generated by the state flip-flop 259 to place the assignment system in its assign mode, the flip-flop 16 is reset.

The keyswitch counter 17 is reset only if the number of actuated keys on the present keyboard scan differ from the number of actuated keys on the previous keyboard scan. The RESET signal created by the AND gate 23 is used to transfer the count state of the keyswitch counter 17 to the key number register 21. After this transfer has been completed, the RESET signal initializes the keyswitch counter 17 to its minimum count state.

The comparator 22 compares the current state of the keyboard counter 17 with the previous count which is stored in the key number register 21. If the count has changed, signified by a difference in the input data, the comparator 22 generates a REPEAT signal.

The solo detect 199 generates a SOLO signal if the count state of the keyswitch counter 17 indicates a single count corresponding to a single actuated keyswitch on the keyboard.

Figure 3:
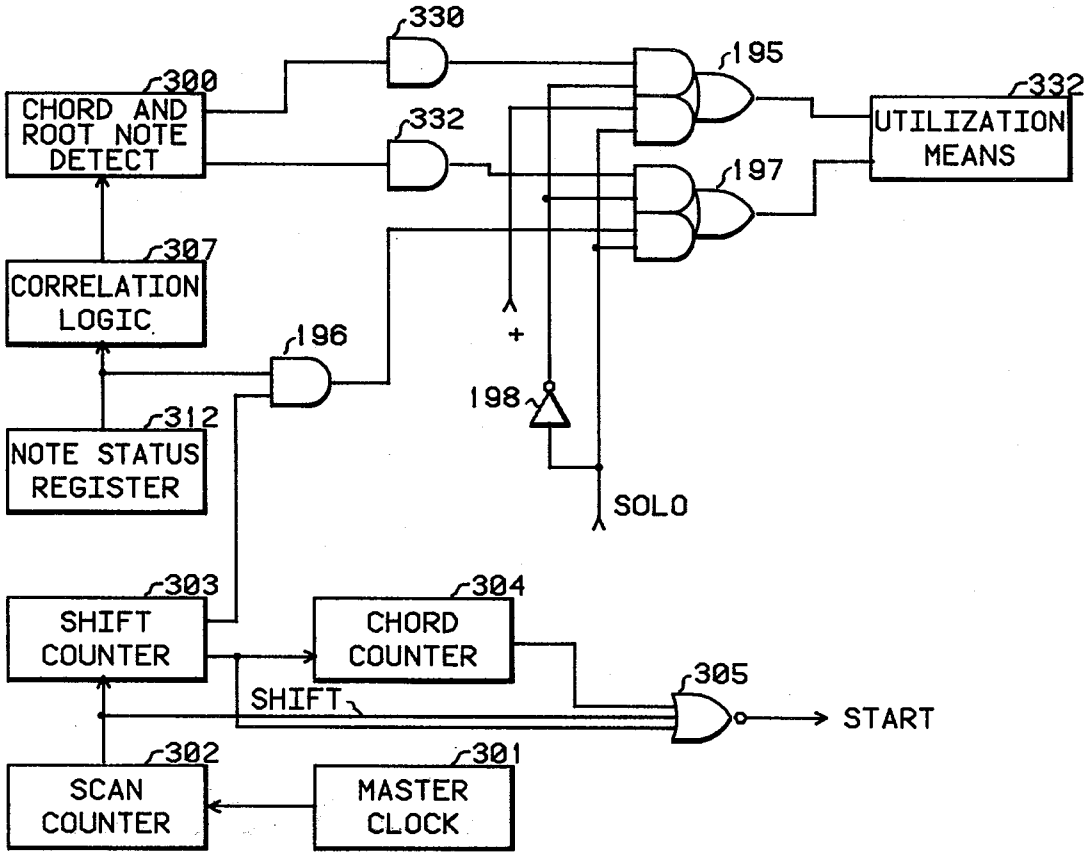
FIG. 3 is a schematic diagram of the chord detect 4 of FIG. 1.

FIG. 3 illustrates the modification added to the system disclosed in the referenced U.S. Pat. No. 4,282,786 to implement the chord detect 4 and the root note detector 5. The blocks with the "300" series numbers correspond to the numbered system blocks in the referenced patent which are labeled in the figures as 300 less than the numbers shown here in FIG. 3. The box labeled chord and root note detect 300 contains the remainder of the chord and root note system logic not explicitly shown in FIG. 3. In the manner described in U.S. Pat. No. 4,282,786 actuated keyswitch status data is stored in the note status register 312. The count state of the shift counter 303 corresponds to the note in the musical octave for the current switch status data read out of the note status register.

If the SOLO signal is not generated, then the data output from the set of AND gates labeled 331 is transferred via the set of select gates 197 to the utilization means 332. In the present system, the utilization means 332 symbolizes the subsystem shown in FIG. 1 which utilizes the data generated by the chord detect 4 and the root note detector 5. The AND-gate 330 and the select gate 195 each represent a set of 3 identical gates while the AND-gate 331 and the select gate 197 each represent a set of 4 identical gates.

The AND-gate 196 represents a set of 4 identical gates which can transfer one of the twelve count states from the shift counter 303. The AND-gate 196 will transfer the count state of the shift counter 303 if the current data read out of the note status register 312 corresponds to an actuated keyboard switch.

The set of select gates 197 will transfer the root note data from the AND-gate 331 to the utilization means 332 if the SOLO signal is not in its logic "1" state. If the SOLO signal is in its logic "1" state the select gates 197 will transfer the count state of shift counter 303 and the select gate 195 will transfer a data set in which all bits are logic "1".

Figure 4:
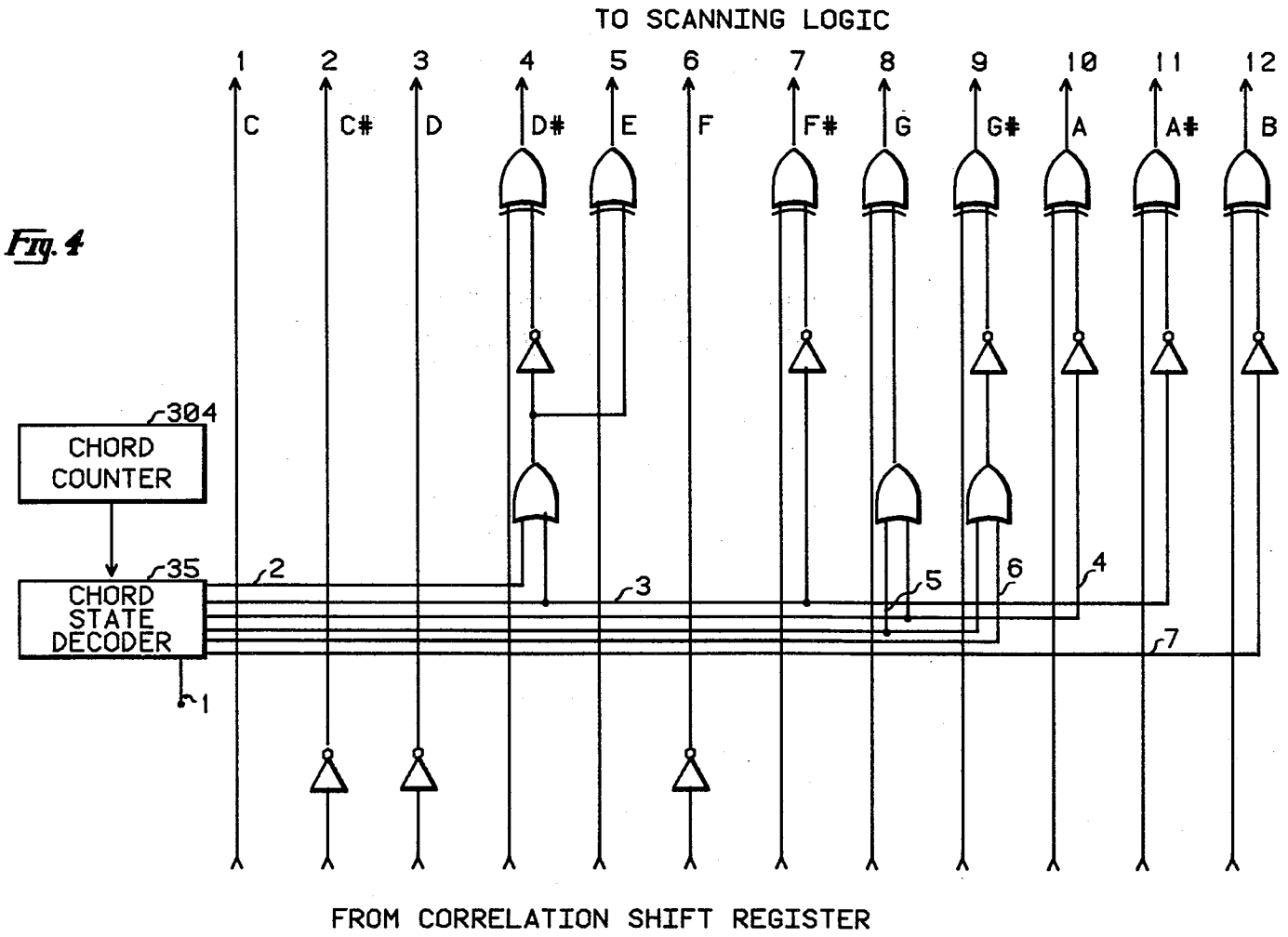
FIG. 4 is a schematic diagram of the correlation logic.

For a guitar imitative system, FIG. 4 illustrates an advantageous implementation of the correlation logic 7 shown in FIG. 4 of the referenced U.S. Pat. No. 4,282,786. The binary count states of the chord counter 304 are decoded onto the seven labeled lines. The lines and the corresponding chord types implemented by the logic of FIG. 4 are listed in Table 1.

TABLE 1

| | | Correlation Logic | | | | | | | | | | | |
|---|---|---|---|---|---|---|---|---|---|---|---|---|---|
| Chord Counter | Chord Type | C | C# | D | D# | E | F | F# | G | G# | A | A# | B |
| 1 | Major | 1 | 0 | 0 | 0 | 1 | 0 | 0 | 1 | 0 | 0 | 0 | 0 |
| 2 | Minor | 1 | 0 | 0 | 1 | 0 | 0 | 0 | 1 | 0 | 0 | 0 | 0 |
| 3 | Dom. 7th | 1 | 0 | 0 | 0 | 1 | 0 | 0 | 1 | 0 | 0 | 1 | 0 |
| 4 | Dim. | 1 | 0 | 0 | 1 | 0 | 0 | 1 | 0 | 0 | 1 | 0 | 0 |
| 5 | Aug. 5th | 1 | 0 | 0 | 0 | 1 | 0 | 0 | 0 | 1 | 0 | 0 | 0 |
| 6 | Sixth | 1 | 0 | 0 | 0 | 1 | 0 | 0 | 1 | 1 | 0 | 0 | 0 |
| 7 | Major 7th | 1 | 0 | 0 | 0 | 1 | 0 | 0 | 1 | 0 | 0 | 0 | 1 |

It is noted, as shown in FIG. 4, that line 1 is not decoded. An examination of the logic shows that in the absence of a signal on lines 2 through 7, then by default the logic is operable for a major chord as shown in Table 1. The correlation logic, as described in U.S. Pat. No. 4,282,786, comprises an implementation of a matched filter processor.

The system operational function provided by the chord detect 4 and root note detector 5 assures that independent of what combination of keyswitches are actuated, a true musical chord is selected from the preselected library of musical chords. This selection will produce a true musical chord which is closest to the combination of actuated switches in a least mean square error criterion. It is a feature of this subsystem that the notes keyed on the strum keyboard will not, in general, be the notes produced by the system of tone generators. As detailed in U.S. Pat. No. 4,282,786, for example, a two note input combination can result in a musical chord having three or more notes. In a manner to be described, the tone generators in the present system will sound a chord which spans the octaves covered by the six strings of a guitar. If a nonsense combination of switches are actuated that does not exactly correspond to a true musical chord, the chord detect and root note detect subsystem will correct the error by selecting the closest musical chord from the given library of musical chords.

Figure 5:
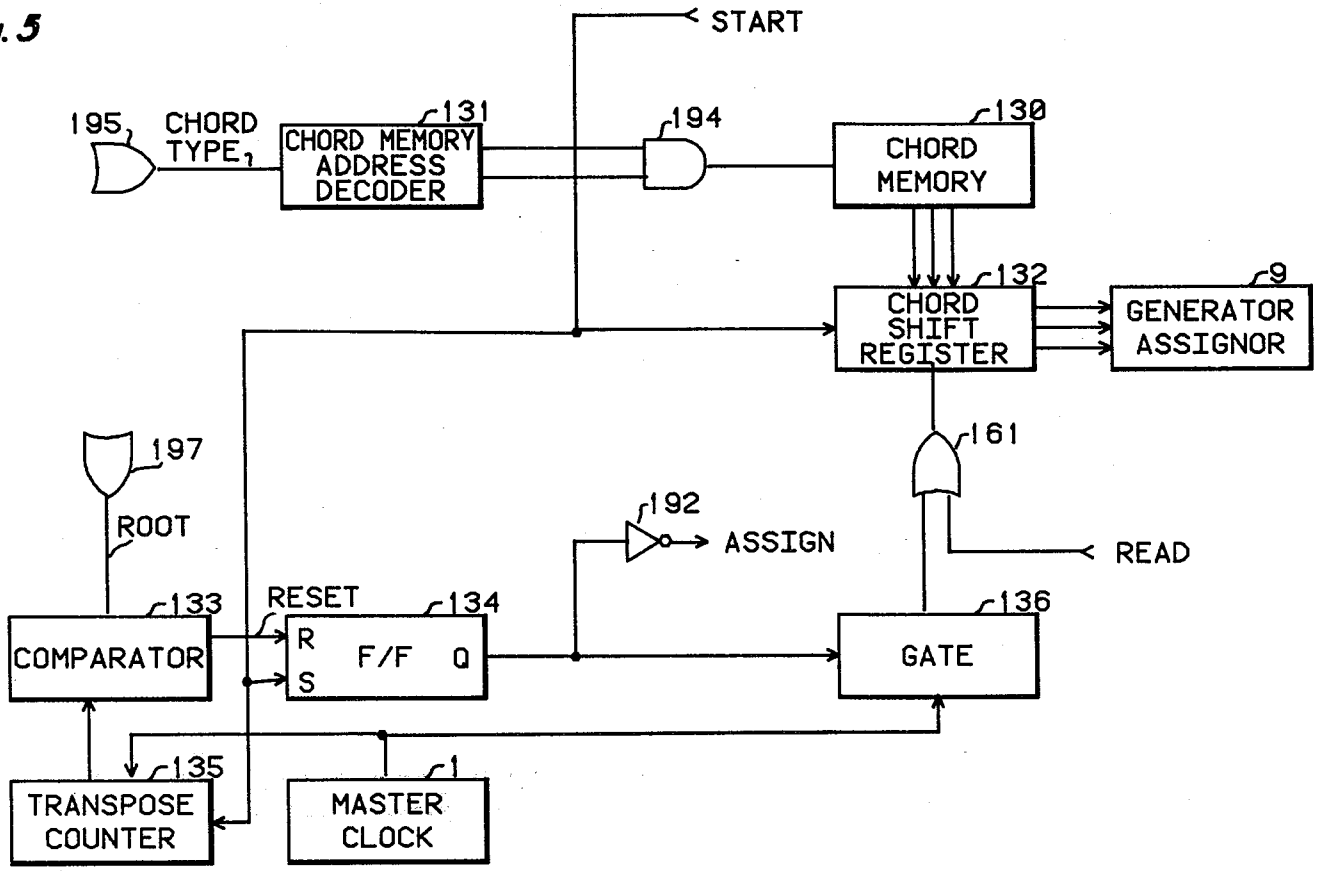
FIG. 5 is a schematic diagram of the chord transpose 6 of FIG. 1.

FIG. 5 shows the detailed system logic for the chord transpose 6. The function of the chord transpose 6 is to transpose the musical chord data selected by the chord select 4 to a musical key corresponding to the root note produced by the root note detector 5. It is also a system function of the chord transpose 6 to use the musical chord type data input to generate chords that correspond to those generally played on a guitar having six strings.

The chord memory 130 can be implemented as a ROM (read only memory) storing the seven binary words listed in Table 2. Each word corresponds to a chord type listed in the table.

TABLE 2

| Chord Type | G3 | G# | A | A# | B | C4 | C# | D | D# | E | F | F# | G | G# | A | A# | B | C5 | C# | D | D# | E | F | F# | G |
|---|---|---|---|---|---|---|---|---|---|---|---|---|---|---|---|---|---|---|---|---|---|---|---|---|---|
| MAJOR | 1 | 0 | 0 | 0 | 0 | 1 | 0 | 0 | 0 | 1 | 0 | 0 | 1 | 0 | 0 | 0 | 0 | 1 | 0 | 0 | 0 | 1 | 0 | 0 | 0 |
| MINOR | 1 | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 0 | 1 |
| DOM. 7th | 1 | 0 | 0 | 0 | 0 | 1 | 0 | 0 | 0 | 1 | 0 | 0 | 0 | 0 | 0 | 1 | 0 | 1 | 0 | 0 | 0 | 1 | 0 | 0 | 0 |
| DIM. | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 |
| AUG. | 0 | 0 | 0 | 0 | 0 | 1 | 0 | 0 | 0 | 1 | 0 | 0 | 0 | 1 | 0 | 0 | 0 | 1 | 0 | 0 | 0 | 1 | 0 | 0 | 0 |
| SIXTH | 0 | 0 | 0 | 0 | 0 | 0 | 0 | 0 | 0 | 1 | 0 | 0 | 0 | 0 | 1 | 0 | 0 | 1 | 0 | 0 | 0 | 0 | 0 | 0 | 1 |
| MAJ 7th | 1 | 0 | 0 | 0 | 0 | 1 | 0 | 0 | 0 | 1 | 0 | 0 | 1 | 0 | 0 | 0 | 1 | 0 | 0 | 0 | 0 | 1 | 0 | 0 | 0 |
| SOLO NOTE | 0 | 0 | 0 | 0 | 0 | 1 | 0 | 0 | 0 | 0 | 0 | 0 | 0 | 0 | 0 | 0 | 0 | 0 | 0 | 0 | 0 | 0 | 0 | 0 | 0 |

Table 2 is an abridged listing of the stored data. The remainder of the notes for an organ keyboard having a range of $C_2$ to $B_6$ will have a zero bit value.

The chord memory address decoder 131 receives the chord type data in the form of a binary word from the set of select gates 195. This binary word is transformed to a memory address for accessing a chord binary word stored in the chord memory 130.

The chord data, in the form of a binary word, accessed from the chord memory 130 is transposed to correspond to the selected root note by means of the chord shift register 132. The chord shift register 132 is a shift register having a number of bits equal to the number of keyswitches contained in the upper keyboard switch array. This shift register is parallel loaded with the chord data word accessed out from the chord memory 130 in the bit positions of the shift register 132 corresponding to the indicated notes shown in Table 2.

Data from the chord memory 130 is loaded into the chord shift register in response to the START signal generated by the chord detect 4. The generation of the START signal, as described in U.S. Pat. No. 4,282,786, occurs when the scan counter 302, the shaft counter 303, and the chord counter 304 are simultaneously in their initial count state. The old data stored in the chord shift register 132 is cleared, and the contents initialized to a logic "0" state before the new data is read out of the chord memory 130.

The chord data word loaded into the chord shift register 132 is shifted to the right by a number of bit positions equal to one less than the root note number. the root note number, or chord root note, is the root note expressed as a numerical position in the musical octave. The numbering convention is such that the musical note C is assigned the note number 1 and the musical note B is assigned the note number 12. For example, F# corresponds to the note number 6. As the data is shifted to the right in the chord shift register 132, a zero binary bit is placed at the input to the shift register to replace the data shifted out at the other end. At the conclusion of the data shifting operation, the data residing in the chord shift register 132 is called the transposed data set. The resulting chord data word is said to have been "transposed". It is recognized that the transposition operation corresponds to a cyclic permutation of the chord data word.

In response to the START signal from the chord detect 4, the flip-flop 134 is set and the transpose counter 135 is reset to its initial count state. When flip-flop 134 is set, a logic state Q="1" signal is transmitted to the gate 136. In response to a input "1" logic state signal, gate 136 transmits timing signals from the master clock 1 which are used to cause a right shift of the data stored in the chord shift register 132.

The transpose counter 135 is incremented by the timing signals generated by the master clock 1.

When the comparator 133 finds that the count state of the transpose counter 135 is one less than the root number transmitted via the set of select gates 197, a RESET signal is generated. This RESET signal is used to reset the flip-flop 134 thereby causing the shift signals to be inhibited from reaching the chord shift register 132 via the gate 136.

Since the master clock 1 is advantageously operated at a 1 Mhz rate, the maximum time required for the chord transpose operation is 12 microseconds. This short time interval is essentially equal to an instantaneous response for a tone generation system. When the flip-flop 134 has been reset, the chord shift register contains the chord data corresponding to the six guitar strings that has been transposed with respect to the detected root note.

The inverter gate 192 generates an ASSIGN signal when the state of the output of the flip-flop 134 is Q="0". The ASSIGN signal is used to signify that the chord transposition action has been completed.

Figure 6:
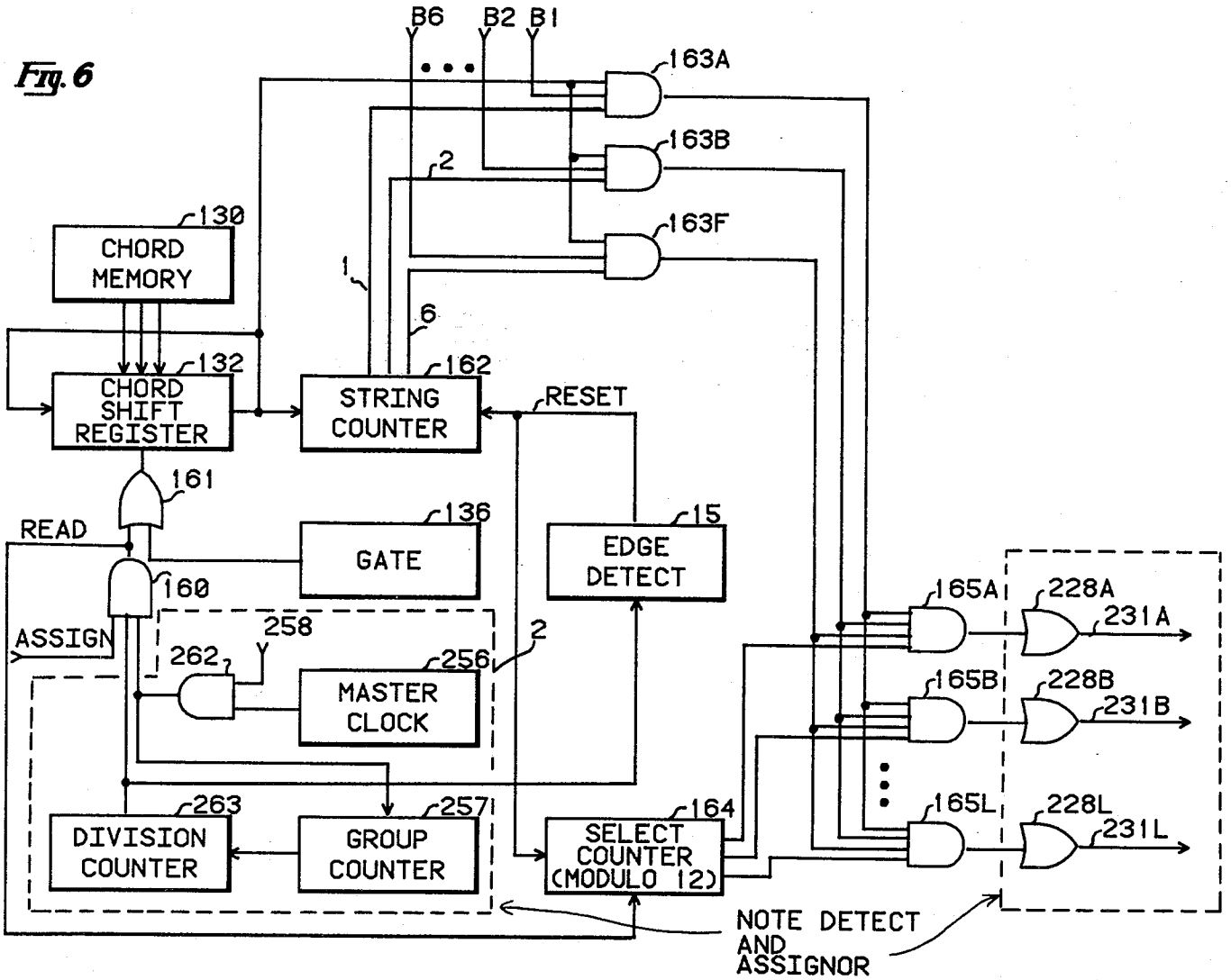
FIG. 6 is a schematic diagram of the generator assignor 9 of FIG. 1.

FIG. 6 illustrates the detailed system logic of the generator assignor 9. The function of this subsystem is to transform the transposed data set residing in the chord shift register 132 into tone generator assignments corresponding to a sequence of strummed strings.

The system elements master clock 256, division counter 263, group counter 257, AND-gate 262, and the set of OR-gates 228A–228L, are all elements of the note detect and assignor 2. These elements are shown in FIG. 2 of the referenced U.S. Pat. No. 4,022,098.

If the logic state of line 258 is a "1", then the group counter 257 will be incremented by the timing signals provided by the master clock 256. These same signals are used to shift stored data out of the chord shift register 132. As detailed in U.S. Pat. No. 4,022,098 the state of line 258 will be a logic "1" if the note detect and assignor 2 is in its search mode while it is scanning the keyswitches to find an actuated (closed) switch.

The timing signals from the master clock 256 are transferred to the chord shift register 132 if the ASSIGN signal has been generated and if the logic state of line 242 is a "1" signifying that the upper keyboard switches are being scanned by the note detect and assignor 2. The transposed data set residing in the chord shift register 132 is read out in response to the signals provided by the AND gate 160 in the direction corresponding to the lowest to the highest musical notes.

When a "1" logic state signal appears on line 242, edge detect 15 creates a pulse-like signal which is used to reset the select counter 164 and the string counter 162 to their initial count states.

The string counter 162 is implemented to count modulo 6 and is used to assign the transposed data to each of the six tone generators that correspond to the six strings of a guitar. String counter 162 contains a data decode so that each of its 6 binary count states is decoded onto one of the six output count data lines. Each time that a logic "1" bit state is addressed out of the chord shift register 132, the count state of the string counter 162 is incremented.

Figure 7:
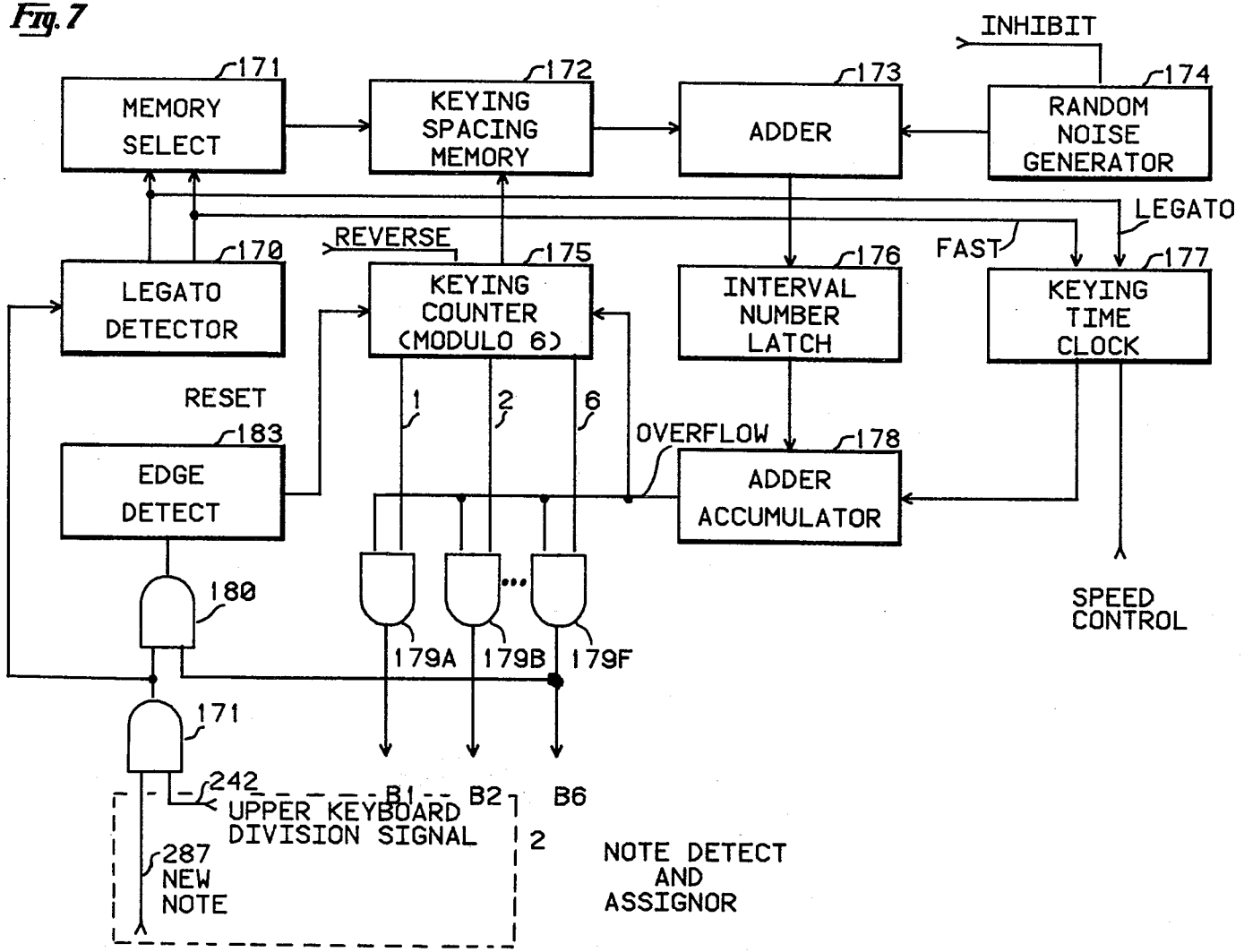
FIG. 7 is a schematic diagram of the strum interval generator 11 of FIG. 1.

The keying, or strum, data appears on the six data lines labeled B1–B6. The generation of the keying data is shown in FIG. 7 and described below.

In the described fashion a signal will appear at the output of AND-gate 163A, for example, when the chord data for the first "string" has been read out of the chord shift register and a keying signal appears on line B1. The word "string" is used herein in a generic sense to denote one of the six tone generators that are assigned to generate the guitar sounds for both a solo and strum operational modes. If a note data is accessed from the chord shift register 132 when no strum signal is present on a particular keyboard scan, this omission is of no consequence because the keyboard scan is repeated with sufficient speed that as soon as a strum signal occurs on a given line B1–B6, an output signal will be generated by one of the set of AND-gates 163A–163F. This is a consequence of scanning the keyboards at a much faster speed than the speed of changing the states of the strum signals. The set of signal lines from the output of the AND-gates 163A–163F are called the keying signal lines.

The set of tselve AND-gates 165A–165L are used to convert the string keyed information furnished by the AND-gates 163A–163F into note information which can be detected and assigned in the normal fashion by the note detect and assignor subsystem described in the referenced U.S. Pat. No. 4,022,098. The select counter 164 is implemented to count modulo 12. This counter is incremented each time that the chord shift register 132 is shifted to read out a data bit. The binary count state of the select counter 164 is decoded onto 12 signal lines. These lines are called the string signal lines. In this fashion the 12 decoded output states of the select counter 164 correspond to the twelve notes contained in a musical octave. The 12 signal lines are used to decode the keying signals from the set of AND-gates 163A–163F into musical note signals, or note data, which are transferred to the set of OR-gates 228A–228L. The OR-gates 228A–287 are contained in the note detect and assignor 2 and their system function as a subset of the note detect and assignment operation is described in the referenced U.S. Pat. No. 4,022,098. A signal appearing at the input to one of these OR-gates is exactly equivalent to an actuated keyswitch for the function of assigning tone generators to the upper keyboard.

The ADSR generator 7, shown in FIG. 1, can be implemented using any of the known implementations of tone envelope generators having the capability of varying the speed of the attack, decay, and release phases of the modulation function in response to a control signal. A suitable ADSR generator subsystem is described in U.S. Pat. No. 4,079,650 entitled "ADSR Envelope Generator." This patent is hereby incorporated by reference.

The tone envelope function used to imitate a guitar sound is usually one which quickly reaches its maximum value in response to a keyswitch actuation. After reaching the maximum value, the tone envelope function immediately enters a release phase which is initiated even if the keyswitch remains in its actuated state. This system action is described in the referenced U.S. Pat. No. 4,079,650. Because of this automatic release phase action of the ADSR generator 7, it is not necessary to provide any memory for latching the output states of the set of six AND-gates 163A–163F. Thus once a single note detect signal is generated at the output of the set of AND-gates 165A–165L, the ADSR function generator for the assigned tone generator is automatically placed in a release mode which requires no further control signals from the remainder of the keying system.

If for some reason, the present invention is used for tone generators having a more general form of the ADSR envelope function in which attack and release time control signals are used, then a memory latch should follow each of the set of AND-gates 163A–163F so that the note keying data is retained as long as a keying signal appears on the corresponding data lines B1–B6.

FIG. 7 illustrates the logic system for the strum interval generator 11 which generates the six strum keying signals B1–B6. When the note detect and assignor 2 detects a keyswitch state that has changed from an unactuated state to an actuated state, a binary logic "1" signal is generated on line 287. The generation of this signal is described in the referenced U.S. Pat. No. 4,022,098. AND-gate 181 will generate a "1" logic state signal if a new note has been detected while the upper keyboard is scanned because a "1" logic signal exists on line 242 while the keyswitch states are scanned on the upper keyboard.

A RESET signal will be generated from the output of the AND-gate 180 if a "1" state signal is generated by AND-gate 181 and if the keying counter 175 has been incremented to its 6th count state. The output of the AND-gate 180 is converted to a pulse-like signal by means of the edge detect 183. The keying counter 175 is implemented to count modulo 6 which is the number of tone generators assigned to the upper keyboard to generate the guitar sounds.

The legato detector 170, as described below, will produce a LEGATO signal or a FAST signal depending upon the time interval between successive new note signals. The memory select 171 will select one of two sets of data to be read out of the keying spacing memory 172 depending upon the states of the LEGATO and FAST signals.

Figure 8:
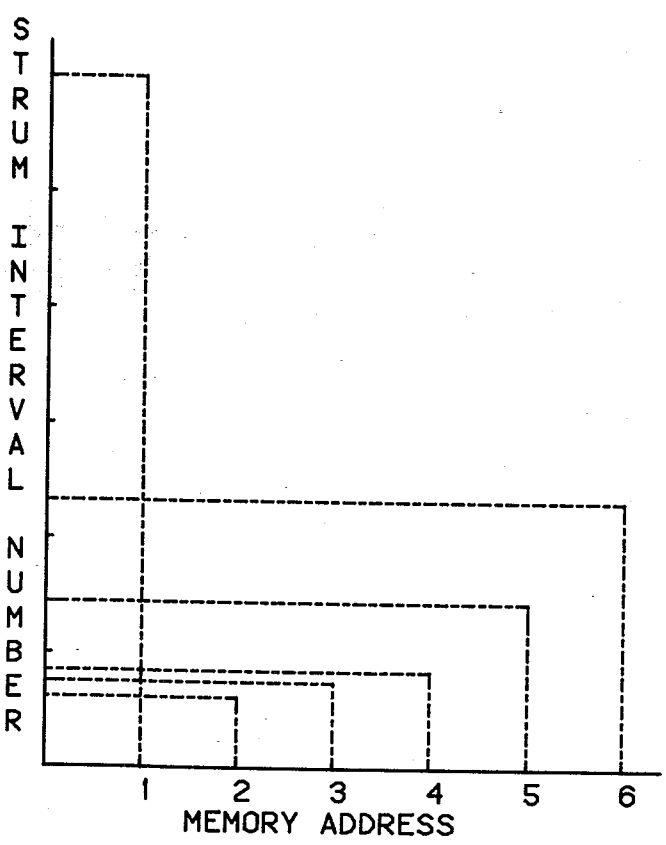
FIG. 8 is a graph of two sets of keying data.
Figure 8:
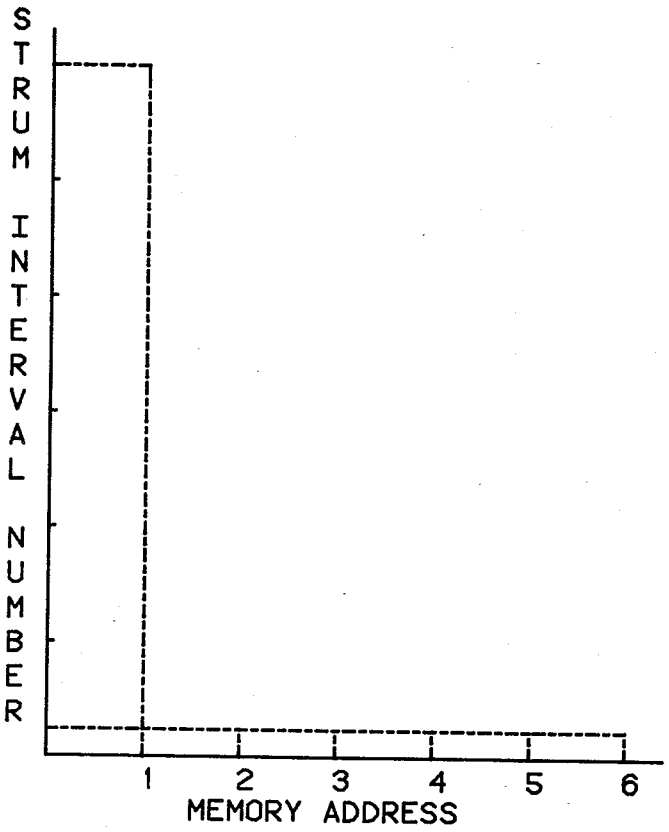

FIG. 8 illustrates an example of the two sets of keying spacing data stored in the keying spacing memory 172. The left graph is data for a linear set of points which are selected in response to the FAST signal. The right graph is data for an exponential set of points which are selected in response to the LEGATO signal.

The count states of the keying counter 175 are used to address data out of the keying spacing memory 172 from the data set selected in response to the LEGATO and FAST signal states. The data values accessed from the keying spacing memory 172 are added to a random number generated by the random number generator 174 by means of the adder 173. The addition of a random number is used so that the resultant strum keying signals will not be precisely separated by fixed time intervals. In this fashion a mechanical-like precise timing quality is avoided for the strummed tone generators. If a precise set of time intervals is desired for special musical effects, the output of the random number generator can be inhibited by means of an INHIBIT signal.

The output data value, called the interval number, from the adder 173 is stored in the interval number latch 176. The interval number stored in the interval number latch 176 is added to the contents of the adder-accumulator 176 in response to each clock pulse produced by the The state of the counter 405 is compared with P by means of the the accumulator contained in the adder-accumulator 178 changes its logic state from a "1" to a "0", an OVERFLOW signal is generated.

The keying time clock 177 is implemented as a variable speed clock whose frequency can be varied by means of an external SPEED CONTROL signal. The SPEED CONTROL signal can be varied by the musician to control the speed of the strum keying signals.

The count state of the keying counter 175 is incremented by the OVERFLOW signal generated by the adder-accumulator 178. The binary count states of the keying counter 175 are decoded onto six signal lines connected to the six AND-gates 179A–179F. Thus, for example, a keying signal B2 will be placed in a binary logic state "1" if the keying counter 175 is in the second count state and an OVERFLOW signal is generated by the adder-accumulator 178.

The FAST and LEGATO signals generated by the legato detector 170 are used to select one of two preselected frequencies for the keying time clock 177. The higher of these two frequencies is selected if the FAST signal has been generated. The SPEED CONTROL varies both of these preselected frequencies.

Advantageously the keying time clock 177 can be set for a nominal frequency of 10 Khz. The accumulator in the adder-accumulator 178 will reset at the value 10,000. If the FAST data set in the keying spacing memory 172 have the values 10,000,400,400,400,400,400. then the strum keying signals B1–B6 will be generated with a time interval spacing of 0.04 sounds. The first value is a 1 so that the strum signal B1 will be generated almost instantaneously after the NEW NOTE signal is generated. For the second, or legato, data set the values 10,000,1017,1245,1406,2403,3869 will provide an exponential strum keying sequence with a total time span of about one second.

For a further realism in imitating guitar playing, the keying counter 175 can be implemented as an up/down, or bidirectional, counter. The direction of the count is controlled by the state of the REVERSE control signal. If the REVERSE control signal is in its binary "1" logic state, the count states will be decremented by the OVERFLOW signals generated by the adder-accumulator 178. The use of a bidirectional counter allows the guitar strum to be generated either in an increasing frequency sequence or in a decreasing frequency sequence.

The comparator 22, in FIG. 2, generates a REPEAT signal if the number of keys actuated on the upper keyboard is the same for the present scan as it was for the prior scan. This REPEAT signal can be used for the REVERSE signal control for the bidirectional implementation of the keying counter 175. The repeat signal is operational if the REPEAT STRUM control signal to the AND-gate 191 is in a "1" binary logic state.

It should be noted that if a chord is to be repeated, it is only necessary that a single note on the upper keyboard be lifted at the end of a strum and then actuated again. Thus it is convenient to obtain a rapid series of strums, which can alternate in frequency direction, because only a single finger must move on the keyboard. The remainder of the chord notes can remain depressed.

Figure 9:
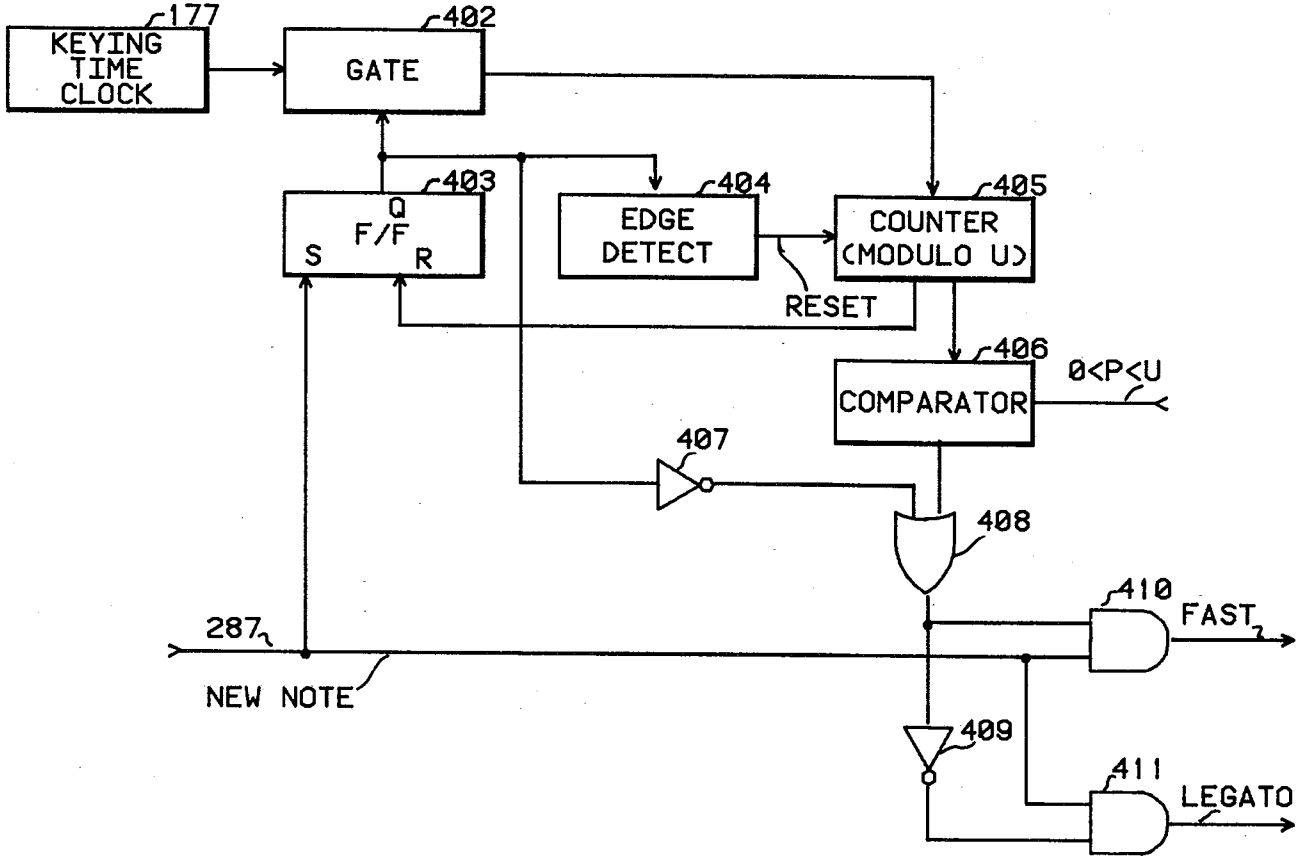
FIG. 9 is a block diagram of the legato detector 170.

The detailed logic of the legato detector 170 is shown in FIG. 9. The legato detector is implemented in the manner disclosed in the copending patent application No. 06/184,707 filed on Sept. 8, 1980, now U.S. Pat. No. 4,332,183, and entitled "Automatic Legato Keying For A Keyboard Electronic Musical Instrument." The referenced application has a common assignee with the present invention.

The keying time clock 177 serves as a source of timing signals. When a NEW NOTE signal appears on line 287 from the note detect and assignor 2, the flip-flop 403 is set. The change in state of the output Q of the flip-flop 403 is converted into a reset signal by means of the edge detect 404.

Counter 405 is implemented to count modulo a preselected number U. When this counter resets itself a reset signal is generated which will reset the flip-flop 403. The counter 405 is reset to an initial state in response to the RESET signal furnished by the edge detect 404. The state of the counter 405 is called the time interval number.

To illustrate the system logic, consider the case in which the count state of counter 405 is at some number D which is less than the maximum count U. Moreover, assume that D is also less than a second preselected number P. The value of P is also less than U. D is permitted to have a zero value corresponding to the minimal count state of the counter 405. P is simply a preselected time interval number.

The state of the counter 205 is compared with P by means of the comparator 406. The value of P can be provided by any of a variety of implementations. P could be obtained from a keyboard input similar to a hand-held calculator, or P could be a number read out from an addressable memory in response to an address signal.

If D is less than P, the comparator 406 generates a "1" output binary logic state which is transmitted as a signal input to the OR-gate 408. Thus if a new note has been assigned and if D is less than P, AND-gate 410 will generate a binary "1" logic state for the FAST signal. If D is greater than P but less than U, the comparator 406 will transmit a "0" binary logic state signal via OR-gate 408 to the inverter 409. thus if D is greater than P, a NEW NOTE signal will cause AND-gate 411 to generate a binary logic state of "1" for the LEGATO signal.

When the counter 405 is allowed to reach its maximum count, which will occur in the absence of newly assigned notes, the flip-flop 403 is reset so that the next detected and assigned note will restart the previously described timing sequences. It is noted that consecutive notes actuated wuthin a time interval corresponding to P counts of the counter 405 will all be assigned a FAST control signal. This operational logic accomodates the situation in which all the notes of a chord may not be actuated in the ideal simultaneous fashion. Notes that follow each other with a time interval greater than P and less than U (expressed as count times of the counter 405) will be assigned a LEGATO control signal with the exception of the first actuated note in such a sequence of notes. This first actuated note will be assigned the FAST control signal.

The fast and legato strum modes are entered automatically and the selection is adaptive to the manner of actuating the keyboard switches as well as to the tempo at which the music is played. The value of P is adjusted to the taste of the musician.

An additional realism can be readily obtained by expanding the data values stored in the chord memory 130, shown in FIG. 5. As previously described, a single chord type was used for all musical keys by employing a transposition shift register whose action was responsive to the detected root note. It is well-known that because of the physical construction of the fret-board, a guitar player does not, or cannot, use all six strings for each chord type as transposed to each of the possible musical keys. This effect can be readily duplicated by storing a chord type for each key. This requires a total of $7\times12=96$ sets of chord types for the seven basic chords in the 12 possible keys. The data set values are tabulated in Table 3.

TABLE 3

| Major | E3 | F | F# | G | G# | A | A# | B | C4 | C# | D | D# | E | F | F# | G | G# | A | A# | B | C5 | C# | D | D# | E | F | F# | G | G# | A |
|---|---|---|---|---|---|---|---|---|---|---|---|---|---|---|---|---|---|---|---|---|---|---|---|---|---|---|---|---|---|---|
| C: | 0 | 0 | 0 | 1 | 0 | 0 | 0 | 0 | 1 | 0 | 0 | 0 | 1 | 0 | 0 | 1 | 0 | 0 | 0 | 0 | 1 | 0 | 0 | 0 | 1 | 0 | 0 | 0 | 0 | 0 |
| C#: | 0 | 0 | 0 | 0 | 0 | 0 | 0 | 0 | 0 | 0 | 0 | 0 | 0 | 0 | 0 | 0 | 1 | 0 | 0 | 0 | 0 | 1 | 0 | 0 | 0 | 1 | 0 | 0 | 0 | 0 |
| D: | 0 | 0 | 0 | 0 | 0 | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 0 |
| D#: | 0 | 0 | 0 | 0 | 0 | 0 | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 |
| E: | 1 | 0 | 0 | 0 | 0 | 0 | 0 | 1 | 0 | 0 | 0 | 0 | 1 | 0 | 0 | 0 | 1 | 0 | 0 | 1 | 0 | 0 | 0 | 0 | 1 | 0 | 0 | 0 | 0 | 0 |
| F: | 0 | 1 | 0 | 0 | 0 | 0 | 0 | 0 | 1 | 0 | 0 | 0 | 0 | 1 | 0 | 0 | 0 | 1 | 0 | 0 | 1 | 0 | 0 | 0 | 0 | 1 | 0 | 0 | 0 | 0 |
| F#: | 0 | 0 | 1 | 0 | 0 | 0 | 0 | 0 | 0 | 1 | 0 | 0 | 0 | 0 | 1 | 0 | 0 | 0 | 1 | 0 | 0 | 1 | 0 | 0 | 0 | 0 | 1 | 0 | 0 | 0 |
| G: | 0 | 0 | 0 | 1 | 0 | 0 | 0 | 1 | 0 | 0 | 1 | 0 | 0 | 0 | 0 | 1 | 0 | 0 | 0 | 1 | 0 | 0 | 0 | 0 | 0 | 0 | 1 | 0 | 0 | 0 |
| G#: | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 1 | 0 | 0 | 0 | 0 | 1 | 0 |
| A: | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 1 | 0 | 0 | 0 | 0 | 0 |
| A#: | 0 | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 1 | 0 | 0 | 0 | 0 |
| B: | 0 | 0 | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 1 | 0 | 0 | 0 |

| Minor | E3 | F | F# | G | G# | A | A# | B | C4 | C# | D | D# | E | F | F# | G | G# | A | A# | B | C5 | C# | D | D# | E | F | F# | G | G# | A |
|---|---|---|---|---|---|---|---|---|---|---|---|---|---|---|---|---|---|---|---|---|---|---|---|---|---|---|---|---|---|---|
| C: | 0 | 0 | 0 | 1 | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 0 | 1 | 0 | 0 |
| C#: | 0 | 0 | 0 | 0 | 0 | 0 | 0 | 0 | 0 | 0 | 0 | 0 | 0 | 0 | 0 | 0 | 1 | 0 | 0 | 0 | 0 | 1 | 0 | 0 | 1 | 0 | 0 | 0 | 0 | 0 |
| D: | 0 | 0 | 0 | 0 | 0 | 1 | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 0 | 0 |
| D#: | 0 | 0 | 0 | 0 | 0 | 0 | 1 | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 0 |
| E: | 1 | 0 | 0 | 0 | 0 | 0 | 0 | 1 | 0 | 0 | 0 | 0 | 1 | 0 | 0 | 1 | 0 | 0 | 0 | 1 | 0 | 0 | 0 | 0 | 1 | 0 | 0 | 0 | 0 | 0 |
| F: | 0 | 1 | 0 | 0 | 0 | 0 | 0 | 0 | 1 | 0 | 0 | 0 | 0 | 1 | 0 | 0 | 1 | 0 | 0 | 0 | 1 | 0 | 0 | 0 | 0 | 1 | 0 | 0 | 0 | 0 |
| F#: | 0 | 0 | 1 | 0 | 0 | 0 | 0 | 0 | 0 | 1 | 0 | 0 | 0 | 0 | 1 | 0 | 0 | 1 | 0 | 0 | 0 | 1 | 0 | 0 | 0 | 0 | 1 | 0 | 0 | 0 |
| G: | 0 | 0 | 0 | 1 | 0 | 0 | 0 | 0 | 0 | 0 | 1 | 0 | 0 | 0 | 0 | 1 | 0 | 0 | 1 | 0 | 0 | 0 | 1 | 0 | 0 | 0 | 0 | 1 | 0 | 0 |
| G#: | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 1 | 0 | 0 | 1 | 0 | 0 | 0 | 0 |
| A: | 1 | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 0 | 1 | 0 | 0 | 0 | 1 | 0 |
| A#: | 0 | 1 | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 0 | 1 | 0 | 0 | 0 | 0 |
| B: | 0 | 0 | 1 | 0 | 0 | 0 | 0 | 1 | 0 | 0 | 0 | 0 | 0 | 0 | 1 | 0 | 0 | 0 | 0 | 1 | 0 | 0 | 1 | 0 | 0 | 0 | 1 | 0 | 0 | 0 |

| 7th | E3 | F | F# | G | G# | A | A# | B | C4 | C# | D | D# | E | F | F# | G | G# | A | A# | B | C5 | C# | D | D# | E | F | F# | G | G# | A |
|---|---|---|---|---|---|---|---|---|---|---|---|---|---|---|---|---|---|---|---|---|---|---|---|---|---|---|---|---|---|---|
| C: | 0 | 0 | 0 | 1 | 0 | 0 | 0 | 0 | 1 | 0 | 0 | 0 | 1 | 0 | 0 | 0 | 0 | 0 | 1 | 0 | 1 | 0 | 0 | 0 | 1 | 0 | 0 | 0 | 0 | 0 |
| C#: | 0 | 0 | 0 | 0 | 0 | 0 | 0 | 0 | 0 | 0 | 0 | 0 | 0 | 1 | 0 | 0 | 0 | 0 | 0 | 1 | 0 | 1 | 0 | 0 | 0 | 0 | 0 | 0 | 1 | 0 |
| D: | 0 | 0 | 0 | 0 | 0 | 1 | 0 | 0 | 0 | 0 | 1 | 0 | 0 | 0 | 0 | 0 | 0 | 1 | 0 | 0 | 1 | 0 | 0 | 0 | 0 | 0 | 1 | 0 | 0 | 0 |
| D#: | 0 | 0 | 0 | 0 | 0 | 0 | 1 | 0 | 0 | 0 | 0 | 1 | 0 | 0 | 0 | 0 | 0 | 0 | 1 | 0 | 0 | 1 | 0 | 0 | 0 | 0 | 0 | 1 | 0 | 0 |
| E: | 1 | 0 | 0 | 0 | 0 | 0 | 0 | 1 | 0 | 0 | 0 | 0 | 1 | 0 | 0 | 0 | 0 | 0 | 1 | 0 | 0 | 1 | 0 | 0 | 0 | 0 | 0 | 0 | 1 | 0 |
| F: | 0 | 0 | 0 | 0 | 0 | 0 | 0 | 0 | 1 | 0 | 0 | 0 | 0 | 1 | 0 | 0 | 0 | 1 | 0 | 0 | 0 | 0 | 0 | 1 | 0 | 1 | 0 | 0 | 0 | 0 |
| F#: | 0 | 0 | 0 | 0 | 0 | 0 | 0 | 0 | 0 | 1 | 0 | 0 | 0 | 0 | 1 | 0 | 0 | 0 | 1 | 0 | 0 | 1 | 0 | 0 | 1 | 0 | 0 | 0 | 0 | 0 |
| G: | 0 | 0 | 0 | 1 | 0 | 0 | 0 | 1 | 0 | 0 | 1 | 0 | 0 | 0 | 0 | 1 | 0 | 0 | 0 | 1 | 0 | 0 | 0 | 0 | 0 | 1 | 0 | 0 | 0 | 0 |
| G#: | 0 | 0 | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 1 | 0 |
| A: | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 0 | 0 | 0 | 1 | 0 | 0 |
| A#: | 0 | 1 | 0 | 0 | 0 | 0 | 1 | 0 | 0 | 0 | 0 | 0 | 0 | 1 | 0 | 0 | 1 | 0 | 0 | 0 | 0 | 0 | 1 | 0 | 0 | 1 | 0 | 0 | 0 | 0 |
| B: | 0 | 0 | 1 | 0 | 0 | 0 | 0 | 1 | 0 | 0 | 0 | 1 | 0 | 0 | 0 | 0 | 0 | 1 | 0 | 1 | 0 | 0 | 0 | 0 | 0 | 0 | 1 | 0 | 0 | 0 |

| Dim. | E3 | F | F# | G | G# | A | A# | B | C4 | C# | D | D# | E | F | F# | G | G# | A | A# | B | C5 | C# | D | D# | E | F | F# | G | G# | A |
|---|---|---|---|---|---|---|---|---|---|---|---|---|---|---|---|---|---|---|---|---|---|---|---|---|---|---|---|---|---|---|
| C: | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 | 0 | 0 |
| C#: | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 | 0 |
| D: | 0 | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 |
| D#: | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 0 | 1 | 0 | 0 |
| E: | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 1 | 0 | 0 | 0 |
| F: | 0 | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 |
| F#: | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 | 0 | 0 |
| G: | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 | 0 |
| G#: | 0 | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 |
| A: | 0 | 0 | 0 | 0 | 0 | 1 | 0 | 0 | 0 | 0 | 0 | 1 | 0 | 0 | 0 | 0 | 0 | 1 | 0 | 0 | 1 | 0 | 0 | 0 | 0 | 0 | 1 | 0 | 0 | 0 |
| A#: | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 | 0 |
| B: | 0 | 0 | 0 | 0 | 0 | 0 | 0 | 0 | 0 | 0 | 0 | 0 | 0 | 1 | 0 | 0 | 0 | 0 | 0 | 1 | 0 | 0 | 1 | 0 | 0 | 0 | 0 | 0 | 1 | 0 |

| Aug +5 | E3 | F | F# | G | G# | A | A# | B | C4 | C# | D | D# | E | F | F# | G | G# | A | A# | B | C5 | C# | D | D# | E | F | F# | G | G# | A |
|---|---|---|---|---|---|---|---|---|---|---|---|---|---|---|---|---|---|---|---|---|---|---|---|---|---|---|---|---|---|---|
| C: | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 | 1 | 0 | 0 | 0 | 0 | 0 |
| C#: | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 | 0 |
| D: | 0 | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 |
| D#: | 0 | 0 | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 |
| E: | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 | 0 | 0 |
| F: | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 | 0 |
| F#: | 0 | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 |
| G: | 0 | 0 | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 |
| G#: | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 | 1 | 0 |
| A: | 0 | 0 | 0 | 0 | 0 | 1 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 | 0 |
| A#: | 0 | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 |

TABLE 3-continued

| B: | 0 | 0 | 0 | 0 | 0 | 0 | 0 | 0 | 0 | 0 | 0 | 0 | 0 | 0 | 0 | 1 | 0 | 0 | 0 | 1 | 0 | 0 | 0 | 1 | 0 | 0 | 0 | 1 | 0 | 0 |
|---|---|---|---|---|---|---|---|---|---|---|---|---|---|---|---|---|---|---|---|---|---|---|---|---|---|---|---|---|---|---|
| Sixth | E3 | F | F# | G | G# | A | A# | B | C4 | C# | D | D# | E | F | F# | G | G# | A | A# | B | C5 | C# | D | D# | E | F | F# | G | G# | A |
| C: | 0 | 0 | 0 | 0 | 0 | 0 | 0 | 0 | 0 | 0 | 0 | 0 | 1 | 0 | 0 | 0 | 0 | 1 | 0 | 0 | 1 | 0 | 0 | 0 | 0 | 0 | 0 | 1 | 0 | 0 |
| C#: | 0 | 0 | 0 | 0 | 0 | 0 | 0 | 0 | 0 | 0 | 0 | 0 | 0 | 1 | 0 | 0 | 0 | 0 | 1 | 0 | 0 | 1 | 0 | 0 | 0 | 0 | 0 | 0 | 1 | 0 |
| D: | 0 | 0 | 0 | 0 | 0 | 0 | 0 | 0 | 0 | 0 | 0 | 0 | 0 | 0 | 1 | 0 | 0 | 0 | 0 | 1 | 0 | 0 | 1 | 0 | 0 | 0 | 0 | 0 | 0 | 1 |
| D#: | 0 | 0 | 0 | 0 | 0 | 0 | 1 | 0 | 0 | 0 | 0 | 1 | 0 | 0 | 0 | 0 | 0 | 0 | 1 | 0 | 1 | 0 | 0 | 0 | 0 | 0 | 0 | 1 | 0 | 0 |
| E: | 0 | 0 | 0 | 0 | 0 | 0 | 0 | 0 | 0 | 0 | 0 | 0 | 1 | 0 | 0 | 0 | 0 | 0 | 0 | 1 | 0 | 1 | 0 | 0 | 0 | 0 | 0 | 0 | 1 | 0 |
| F: | 0 | 1 | 0 | 0 | 0 | 0 | 0 | 0 | 1 | 0 | 0 | 0 | 0 | 1 | 0 | 0 | 0 | 1 | 0 | 0 | 0 | 0 | 1 | 0 | 0 | 1 | 0 | 0 | 0 | 0 |
| F#: | 0 | 0 | 0 | 0 | 0 | 0 | 0 | 0 | 0 | 0 | 0 | 1 | 0 | 0 | 0 | 0 | 0 | 0 | 1 | 0 | 0 | 1 | 0 | 0 | 0 | 0 | 1 | 0 | 0 | 0 |
| G: | 0 | 0 | 0 | 0 | 0 | 0 | 0 | 0 | 0 | 0 | 1 | 0 | 0 | 0 | 0 | 1 | 0 | 0 | 0 | 1 | 0 | 0 | 1 | 0 | 1 | 0 | 0 | 0 | 0 | 0 |
| G#: | 0 | 0 | 0 | 0 | 0 | 0 | 0 | 0 | 0 | 0 | 0 | 1 | 0 | 0 | 0 | 0 | 1 | 0 | 0 | 0 | 1 | 0 | 0 | 0 | 0 | 1 | 0 | 0 | 0 | 0 |
| A: | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 0 | 0 | 1 | 0 | 0 | 0 |
| A#: | 0 | 0 | 0 | 0 | 0 | 0 | 0 | 0 | 0 | 0 | 0 | 0 | 0 | 1 | 0 | 0 | 0 | 0 | 1 | 0 | 0 | 0 | 1 | 0 | 0 | 0 | 0 | 1 | 0 | 0 |
| B: | 0 | 0 | 0 | 0 | 0 | 0 | 0 | 0 | 0 | 0 | 0 | 0 | 0 | 0 | 1 | 0 | 0 | 0 | 0 | 1 | 0 | 0 | 0 | 1 | 0 | 0 | 0 | 0 | 1 | 0 |
| Maj. 7 | E3 | F | F# | G | G# | A | A# | B | C4 | C# | D | D# | E | F | F# | G | G# | A | A# | B | C5 | C# | D | D# | E | F | F# | G | G# | A |
| C: | 0 | 0 | 0 | 1 | 0 | 0 | 0 | 0 | 1 | 0 | 0 | 0 | 1 | 0 | 0 | 1 | 0 | 0 | 0 | 1 | 0 | 0 | 0 | 0 | 1 | 0 | 0 | 0 | 0 | 0 |
| C#: | 0 | 0 | 0 | 0 | 0 | 0 | 0 | 0 | 0 | 1 | 0 | 0 | 0 | 1 | 0 | 0 | 1 | 0 | 0 | 0 | 1 | 0 | 0 | 0 | 0 | 1 | 0 | 0 | 0 | 0 |
| D: | 0 | 0 | 0 | 0 | 0 | 1 | 0 | 0 | 0 | 0 | 1 | 0 | 0 | 0 | 0 | 0 | 0 | 1 | 0 | 0 | 0 | 1 | 0 | 0 | 0 | 0 | 1 | 0 | 0 | 0 |
| D#: | 0 | 0 | 0 | 0 | 0 | 0 | 1 | 0 | 0 | 0 | 0 | 1 | 0 | 0 | 0 | 0 | 0 | 0 | 1 | 0 | 0 | 0 | 1 | 0 | 0 | 0 | 0 | 1 | 0 | 0 |
| E: | 0 | 0 | 0 | 0 | 0 | 0 | 0 | 0 | 0 | 0 | 0 | 0 | 1 | 0 | 0 | 0 | 0 | 0 | 0 | 1 | 0 | 0 | 0 | 1 | 0 | 0 | 0 | 0 | 1 | 0 |
| F: | 0 | 0 | 0 | 0 | 0 | 0 | 0 | 0 | 0 | 0 | 0 | 0 | 0 | 1 | 0 | 0 | 0 | 1 | 0 | 0 | 1 | 0 | 0 | 0 | 1 | 0 | 0 | 0 | 0 | 0 |
| F#: | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| G: | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 0 | 0 | 0 | 0 | 1 | 0 | 0 | 0 |
| G#: | 0 | 0 | 0 | 0 | 0 | 0 | 0 | 0 | 0 | 0 | 0 | 1 | 0 | 0 | 0 | 0 | 1 | 0 | 0 | 0 | 1 | 0 | 0 | 0 | 0 | 0 | 0 | 1 | 0 | 0 |
| A: | 1 | 0 | 0 | 0 | 0 | 1 | 0 | 0 | 0 | 0 | 0 | 0 | 1 | 0 | 0 | 0 | 0 | 1 | 0 | 0 | 0 | 1 | 0 | 0 | 0 | 0 | 0 | 0 | 1 | 0 |
| A#: | 0 | 0 | 0 | 0 | 0 | 0 | 0 | 0 | 0 | 0 | 0 | 0 | 0 | 1 | 0 | 0 | 0 | 0 | 1 | 0 | 0 | 0 | 1 | 0 | 0 | 0 | 0 | 0 | 1 | 0 |
| B: | 0 | 0 | 0 | 0 | 0 | 0 | 0 | 1 | 0 | 0 | 0 | 0 | 0 | 0 | 1 | 0 | 0 | 0 | 1 | 0 | 0 | 0 | 0 | 1 | 0 | 0 | 1 | 0 | 0 | 0 |

Table 3 is an abridged listing of the stored data. The remainder of the notes for an organ keyboard having a range of notes from $C_2$ to $B_6$ will have a zero bit entry.

Figure 10:
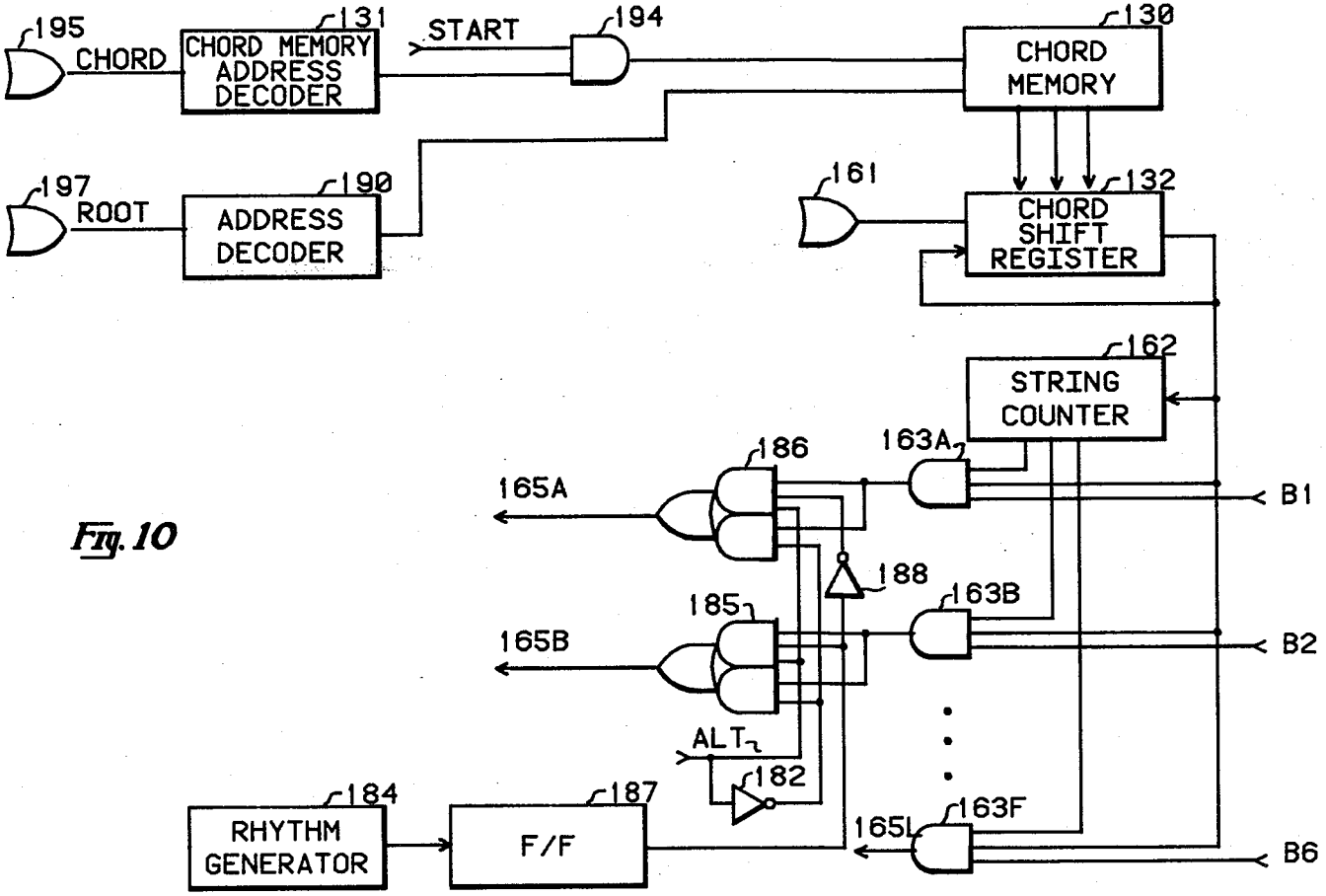
FIG. 10 is a block diagram of the addressing of data from chord memory 130.

FIG. 10 illustrates the method of addressing data from the expanded version of the chord memory 130. The root note number is decoded by means of the address decoder 190 and used to select the set of data for the corresponding musical key for the chord type data address furnished by the chord memory address decoder 131. For rhythmic playing, a guitarist seldom uses both of the lowest strings simultaneously. An alternating bass is easily obtained by means of the rhythm generator 184. In the alternating bass mode of operation, the ALT signal is placed in a "1" binary logic state.

The flip-flop 187 changes its output binary logic state in response to signals received from a rhythm generator. If the ALT signal is in its "1" logic state, then AND-gate 163A and AND-gate 163B will alternately transmit note keying signals from AND-gate 163A to AND-gate 165A and from AND-gate 163B to AND-gate 165B. If the ALT signal is in its "0" state then the alternation is inhibited and the output of ANd-gate 163A is transferred via the select gate 186 to the AND gate 165A and the output of ANd-gate 163B is transferred via the select gate 185 to the AND-gate 165B.

It is noted that the system arrangement always places the lowest note keying signal on the input to the AND-gate 163A and the next lowest note keying signal is placed on the input to AND-gate 163B.

It is also noted that the strum keying logic shown in FIG. 6 is automatically adaptive to the number of chord notes stored in the chord shift register 132 at any time. No special provision is required for either a solo or a chord playing mode or for the number of notes comprising a chord.

I claim:

1. In combination with a keyboard operated electronic musical instrument having keying means comprising an array of keyswitches operable between actuated and released states and having a number of tone generators assigned to actuated keyswitches, apparatus for imitating a strummed stringed musical instrument comprising;

a detection means responsive to operable states of said array of keyswitches wherein a switch data value is generated corresponding to each keyswitch operated in an actuated state, a status memory for storing said switch data values, a chord detect means, responsive to the switch data values stored in said status memory, comprising a matched filter processor wherein a musical chord type is selected from a preselected set of musical chord types irrespectively of whether or not said stored switch data values correspond to a musical chord type, a root note detect means, responsive to the switch data values stored in said status memory, for selecting a chord root note corresponding to said selected musical chord type, an interval measuring means responsive to the switch data values generated by said detection means, whereby a time interval number is generated corresponding to the elapsed time between successive actuated state of the keyswitches in said array of keyswitches, an interval detection means responsive to said time interval number wherein a plurality of control signals are generated, a strum generation means, responsive to said pluarlity of control signals, wherein a sequence of strum keying signals is generated, a note data generator means responsive to said selected chord type and said selected chord root note wherein input note data is generated, a plurality of tone generators operable at frequencies responsive to said input note data, a strum keying means, responsive to said strum keying signals, for selectively providing said input note data to said plurality of tone generators thereby imitating said strummed stringed musical instrument.

2. Apparatus according to claim 1 wherein said array of keyswitches comprises keyswitch connection circuitry whereby said array of keyswitches are electrically connected in parallel octaves.

3. Apparatus according to claim 1 wherein said detection means comprises;

a clock for providing timing signals, a division signal generator, responsive to said timing signals, whereby a division keyboard signal is generated, a keyswitch scanning means whereby said timing signals are applied sequentially to said array of keyswitches in response to said division keyboard signal, a note signal generator responsive to detection signals provided by said keyswitch scanning means whereby a note signal is generated for each keyswitch in said array of keyswitches operated in said actuated state, and a note switch counter incremented by said note signal and reset to an initial count state in response to said division keyboard signal.

4. Apparatus according to claim 3 wherein said detection means further comprises;

a key number register for storing the count state of said note switch counter in response to said division keyboard signal, a number comparison means whereby a repeat signal is generated if the count state of said note switch counter is equal to the count state stored in said key number register, and a solo signal generator, responsive to said division keyboard signal, wherein a solo signal is generated if the count state of said note switch counter has a one count value.

5. Apparatus according to claim 4 wherein said chord detect means comprises;

a chord select means whereby said selected musical chord is provided to said note data generator means if said solo signal is not generated and whereby a preselected solo chord type is provided to said note data generator means if said solo signal is generated, and signal generation circuitry responsive to said timing signals whereby a start signal is generated.

6. Apparatus according to claim 5 wherein said root note detect means comprises;

a root note select means whereby said selected chord root note is provided to said note data generator means if said solo signal is not generated and whereby a chord root note corresponding to an actuated keyswitch in said array of keyswitches is provided to said note data generator means if said solo signal is generated.

7. Apparatus according to claim 1 wherein said interval detection means generates a first control signal if said time interval number is less than a preselected interval time number and wherein a second control signal is generated if said time interval number is greater than said preselected interval time number.

8. Apparatus according to claim 7 wherein said strum generation means comprises;

a strum time clock for providing keying signals at a first frequency in response to said first control signal and for providing keying signals at a second frequency in response to said second control signal, a keying counter incremented by said sequence of keying signals, count initializing circuitry whereby said strum counter is set to an initial count state in response to said division keyboard signal and said note signal, and count decoding means whereby the count state of said keying counter is decoded to generate a strum keying signal on one of a plurality of keying signal lines in response to said keying signals thereby generating said strum keying signals.

9. Apparatus according to claim 8 wherein said strum time clock comprises;

a frequency memory for storing a plurality of sets of frequency numbers, a frequency memory select means for selecting one of said plurality of sets of frequency numbers in response to one of said plurality of control signals, a frequency addressing decoder, responsive to the count state of said keying counter, for reading out a frequency number from said selected one of said plurality of sets of frequency numbers selected by said frequency memory select means, a random number generator for generating a random number, an adder for adding said random number with said read out frequency number to form a random frequency number, and a frequency generating means whereby said keying signals are generated at a frequency corresponding to said random frequency number.

10. Apparatus according to claim 8 wherein said keying counter comprises;

a bidirectional counter which is incremented by said sequence of keying signals if said repeat signal is not generated and which is decremented by said sequence of keying signals if said repeat signal is generated, and initializing means whereby said count initializing circuitry sets said bidirectional counter at an initial minimal count state if said repeat signal is not generated and whereby said count initializing circuitry sets said bidirectional counter an an initial maximal count state if said repeat signal is generated.

11. Apparatus according to claim 8 wherein said note data generator means comprises;

a chord memory for storing a chord word for each of said preselected set of musical chord types, a chord memory select means responsive to said selected musical chord type for accessing a corresponding chord word from said chord memory, and a chord transposition means responsive to said selected chord root note whereby said accessed chord word is transposed.

12. Apparatus according to claim 11 wherein said chord transposition means comprises;

a chord shift register, memory loading circuitry whereby the accessed chord data word from said chord memory is stored in said shift register in response to said start signal, and shift register addressing means responsive to said selected chord root note whereby said chord data word stored in said chord shift register is cyclically permuted.

13. Apparatus according to claim 12 wherein said strum keying means comprises;

a shift register addressing means comprising circuitry for sequentially accessing individual bits comprising said chord data word stored in said chord shift register, a string counter incremented by said bits accessed from said chord shift register having a "one" binary logic state, string counter initializing circuitry whereby said string counter is initialized to an initial count state in response to said division keyboard signal, string decoding means whereby the count state of said string counter is decoded to generate a string signal on one of a plurality of string signal lines, and string select means for combining said plurality of string signal lines and said plurality of keying signals whereby said input note data is generated and provided to said plurality of tone generators.

14. Apparatus according to claim 8 wherein said note data generator means comprises;

a chord memory storing a plurality of chord data words, and a chord memory select means for accessing a chord data word from said chord memory in response to said selected musical chord type and in response to said selected chord root note.

15. Apparatus according to claim 13 wherein said strum keying means further comprises;

a rhythm generator for generating a first and second select signal, and alternating gating means whereby said input note data is selectively inhibited from said plurality of tone generators in response to said first and second select signals.

* * * * *